US008365873B2

(12) United States Patent
Viita-Aho et al.

(10) Patent No.: US 8,365,873 B2
(45) Date of Patent: Feb. 5, 2013

(54) METHOD AND ARRANGEMENT FOR PREVENTING THE UNINTENDED DRIFTING OF AN ELEVATOR CAR

(75) Inventors: Tarvo Viita-Aho, Hyvinkaa (FI); Raimo Kaartinen, Hyvinkaa (FI); Jari Kantola, Sajaniemi (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/421,494

(22) Filed: Mar. 15, 2012

(65) Prior Publication Data

US 2012/0168258 A1 Jul. 5, 2012

Related U.S. Application Data

(63) Continuation of application No. PCT/FI2010/000055, filed on Sep. 8, 2010.

(30) Foreign Application Priority Data

Sep. 16, 2009 (FI) ..... 20090335

(51) Int. Cl.
*B66B 1/34* (2006.01)

(52) U.S. Cl. ..... 187/393; 187/314

(58) Field of Classification Search ..... 187/247, 187/248, 313, 314, 316, 317, 391, 393; 702/179, 702/182–185; 49/25, 28
See application file for complete search history.

(56) References Cited

U.S. PATENT DOCUMENTS

| | | | | |
|---|---|---|---|---|
| 4,750,591 | A * | 6/1988 | Coste et al. | 187/391 |
| 4,930,604 | A * | 6/1990 | Schienda et al. | 187/393 |
| 4,982,815 | A | 1/1991 | Arabori et al. | |
| 5,002,158 | A | 3/1991 | Ericson et al. | |
| 5,760,350 | A * | 6/1998 | Pepin et al. | 187/316 |
| 6,330,936 | B1 * | 12/2001 | Lence Barreiro et al. | 187/393 |
| 6,543,583 | B1 * | 4/2003 | Lence Barreiro et al. | 187/391 |
| 6,604,611 | B2 * | 8/2003 | Liu et al. | 187/391 |
| 6,854,565 | B2 * | 2/2005 | Perala et al. | 187/393 |
| 7,353,916 | B2 * | 4/2008 | Angst | 187/393 |
| 7,699,142 | B1 * | 4/2010 | Wurth et al. | 187/391 |
| 7,775,330 | B2 * | 8/2010 | Kattainen et al. | 187/393 |

(Continued)

FOREIGN PATENT DOCUMENTS

| | | |
|---|---|---|
| EP | 1584597 A1 | 10/2005 |
| FI | 119877 B1 | 4/2009 |

(Continued)

OTHER PUBLICATIONS

International Search Report.

(Continued)

*Primary Examiner* — Anthony Salata

(74) *Attorney, Agent, or Firm* — Harness, Dickey & Pierce, P.L.C.

(57) ABSTRACT

In a method for suppressing drifting of an elevator car away from a stopping floor, an operating condition of one or more machinery brakes of a hoisting machine of an elevator is monitored, and one or more machinery brakes are used to stop the elevator car from leaving a door zone of a stopping floor when at least one of the door of the elevator car and the landing door are open. Start of a next run of an elevator car that has left the door zone of the stopping floor is prevented when the at least one of the door of the elevator car and the landing door are open, and information about the preventing of the next run is recorded in a non-volatile memory of an elevator control unit.

23 Claims, 4 Drawing Sheets

U.S. PATENT DOCUMENTS

| | | | | |
|---|---|---|---|---|
| 7,909,145 | B2 * | 3/2011 | Erny et al. | 187/393 |
| 2006/0175153 | A1 * | 8/2006 | Hubbard et al. | 188/1.11 E |
| 2009/0178889 | A1 * | 7/2009 | Harkonen et al. | 187/373 |
| 2009/0288920 | A1 | 11/2009 | Kattainen et al. | |
| 2010/0155183 | A1 | 6/2010 | Takahashi et al. | |

FOREIGN PATENT DOCUMENTS

| | | | |
|---|---|---|---|
| GB | 2226292 | A | 6/1990 |
| JP | 11005675 | A | 1/1999 |
| WO | WO-2007020325 | A2 | 2/2007 |
| WO | WO-2008102051 | A1 | 8/2008 |
| WO | WO-2008152722 | A1 | 12/2008 |
| WO | WO-2009008183 | A1 | 1/2009 |

OTHER PUBLICATIONS

Finland Search Report.

* cited by examiner

METHOD AND ARRANGEMENT FOR PREVENTING THE UNINTENDED DRIFTING OF AN ELEVATOR CAR

CROSS-REFERENCE TO RELATED APPLICATIONS

This application is a continuation of PCT/FI2010/000055 filed on Sep. 8, 2010, which is an international application and claims priority from FI 20090335 filed on Sep. 16, 2009, the entire contents of each of which are hereby incorporated by reference.

FIELD OF THE INVENTION

The invention relates to preventing the unintended movement of an elevator car and more particularly to preventing the drifting of an elevator car away from the stopping floor.

DESCRIPTION OF PRIOR ART

An elevator hoisting machine comprises one or more machinery brakes, which when activated lock the hoisting machine in position when the elevator stops at a stopping floor. When the elevator is stopped the doors of the elevator car as well as the doors on the stopping floor are opened, in which case passengers are able to leave the elevator car and also to move into the elevator car. In addition, so-called advance opening functions are known in the art, wherein the doors start to be opened immediately when the elevator car arrives in the door zone of the stopping floor, while the elevator car is still moving.

Malfunction of the machinery brakes might cause a dangerous situation for the users of the elevator. A particularly dangerous situation arises if the elevator car drifts from the stopping floor, e.g. due to failure of a machinery brake, exactly when a passenger moving into the elevator car or exiting the elevator car is in the area between the stopping floor and the elevator car.

Publication WO 2007020325 A2 presents a solution to the problem, wherein the operation of the machinery brakes is monitored by activating the brakes sequentially such that initially only the first brake is activated, and the other brakes are activated with a delay. The operating condition of the first brake is monitored by measuring the movement status of the elevator when only the first brake is activated. The solution therefore enables regular and automatic monitoring of the operating condition of the brakes.

Although the aforementioned solution does improve the monitoring of the operating condition of the brakes, and thereby reduces the risk of the drifting of an elevator car away from the stopping floor, other issues relating to the operation of an elevator at the stopping floor must also be addressed. One such issue that must be addressed is a control error of the machinery brake and/or of the elevator motor. This type of control error could be a consequence e.g. of a drive malfunction or of an operating malfunction. Experts subordinate to, and under the direction of, the applicant are thus continuously striving to analyze elevator operation and to make elevators even safer in operation.

PURPOSE OF THE INVENTION

The object of the invention is to provide a solution to the problem of the drifting of an elevator car away from the stopping floor and for preventing the dangerous situation caused by this. To achieve this aim the invention discloses a method and an arrangement for suppressing the drifting of an elevator car away from the stopping floor. The preferred embodiments of the invention are described herein.

SUMMARY OF THE INVENTION

In relation to the characteristic attributes of the invention, reference is made to the claims.

In the solution according to the invention the drifting of an elevator car away from the stopping floor is prevented a) by monitoring the operating condition of one or more machinery brakes of the hoisting machine of the elevator regularly; b) by stopping the elevator car leaving the door zone of the stopping floor when the door of the elevator car and/or the landing door is/are open by using the aforementioned one or more machinery brakes of the hoisting machine; c) by preventing the starting of the next run of an elevator car that has left the door zone of the stopping floor when the door of the elevator car and/or the landing door is/are open; and d) by recording information about the drive prevention in the non-volatile memory of the elevator control unit. By regularly monitoring the operating condition of one or more machinery brakes of the hoisting machine of an elevator it is endeavored to ensure that the aforementioned one or more machinery brakes of the hoisting machine of the elevator are in good operating condition in order to prevent the drifting of an elevator car away from the stopping floor in a situation, in which the elevator car is detected leaving the door zone of the stopping floor when the door of the elevator car and/or the landing is/are open. Furthermore, by preventing the starting of the next run of an elevator car that has left the door zone of the stopping floor it can be ensured that the elevator car is no longer able to continue its travel away from the stopping floor. This is important because movement of the elevator car might, if it continued, cause a shearing hazard to an elevator passenger who has remained between the stopping floor and the elevator car. When information about the drive prevention is also recorded in the non-volatile memory of the elevator control unit, a dangerous situation that would be caused by loss of the drive prevention data when the memory resets, e.g. owing to an electricity outage, can be prevented. This prevention of the resetting of the memory is possible because non-volatile memory retains its data also over an electricity outage. These types of non-volatile memories are e.g. flash EEPROM memory and also e.g. RAM memories with battery backup.

In a preferred embodiment of the invention braking force is exerted on the hoisting machine with at least one, preferably two or more, machinery brakes, which braking force is dimensioned to stop an essentially empty or fully loaded elevator car leaving the door zone of the stopping floor within a stopping distance, which stopping distance is essentially shorter than the length of the entrance of the elevator car in the direction of movement of the elevator car. When the operating condition of the aforementioned one or more machinery brakes is also monitored regularly, it can be ensured that after the movement of an elevator car that has left the door zone of the stopping floor when the door of the elevator car and/or the landing door is/are open has been stopped, there is still sufficient space between the stopping floor and the door opening of the elevator car for an elevator passenger that has possibly remained between the stopping floor and the door opening of the elevator car.

The solution according to the invention can be implemented fully, or at least in large part, with the existing components in elevators. Therefore the solution can be taken into use easily in both new and also old elevators, for instance in connection with a modernization of an elevator.

By means of the invention the possibility of an elevator car drifting away from the stopping floor and/or the danger caused to the passengers of an elevator by the drifting from the stopping floor can be further reduced.

The aforementioned summary, as well as the additional features and additional advantages of the invention presented below will be better understood by the aid of the following description.

BRIEF EXPLANATION OF THE FIGURES

In the following, the invention will be described in more detail by the aid of some examples of its embodiments, which in themselves do not limit the scope of application of the invention, with reference to the attached drawings, wherein.

MORE DETAILED DESCRIPTION OF PREFERRED EMBODIMENTS OF THE INVENTION

Figure 1:
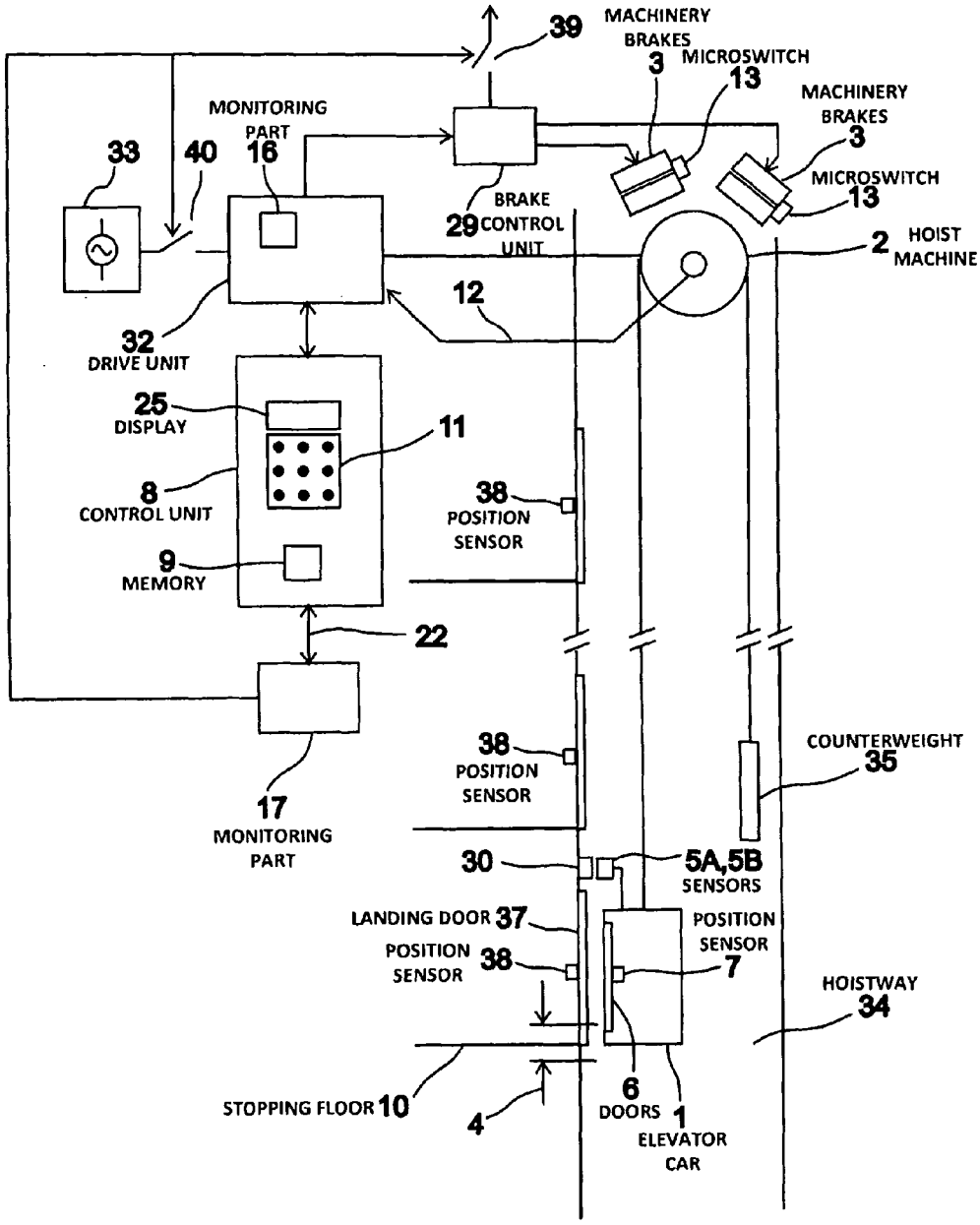
FIG. 1 illustrates an elevator system according to the invention

FIG. 1 illustrates an elevator system according to the invention, in which the elevator car 1 and the counterweight 35 are suspended in the elevator hoistway 34 with ropes passing via the traction sheave of the hoisting machine 2 of the elevator. The elevator car 1 is moved in the elevator hoistway 34 between stopping floors 10 with the hoisting machine 2 in a manner that is, in itself, prior art. When the elevator car 1 has stopped in the door zone 4 of the stopping floor 10, the doors 6 of the elevator car 1 are opened with a door motor. The advance opening function of the elevator system can also start opening the doors 6 of the elevator car immediately when the elevator car 1 arrives in the door zone 4 of the stopping floor 10, already slightly before the elevator car 1 has stopped at the stopping floor 10. When the doors 6 of the elevator car are opened, the door coupler at the same time also opens the landing doors 37 that are at the point of the doors 6 of the elevator car, in which case passengers are able to leave the elevator car and move into the elevator car. When a new run starts, the door motor closes the doors of the elevator car, in which case the door coupler also controls the landing doors closed. The mechanical structure of the landing doors usually also comprises e.g. a counterweight or a spring, which exerts a closing force on the landing doors and thereby ensures that the landing doors close and also stay closed after the elevator car has left the stopping floor 10.

Two electromagnetic machinery brakes 3, e.g. a drum brake or a disc brake, are fixed to the frame of the hoisting machine 2 of the elevator, which brakes when activated are connected to the drum brake or disc brake of a rotating part of the hoisting machine, depending on the operating method of the brake. When they engage, the machinery brakes 3 start to brake the movement of the elevator car 1.

The power supply to the hoisting machine occurs from the electricity network 33 with the drive unit 32 of the hoisting machine. The electricity supply to the electromagnets of the machinery brakes 3 occurs with a brake control unit 29. The machinery brakes 3 open when sufficient current is supplied to the electromagnets and activate when the flow of current in the electromagnets ceases.

Figure 3:
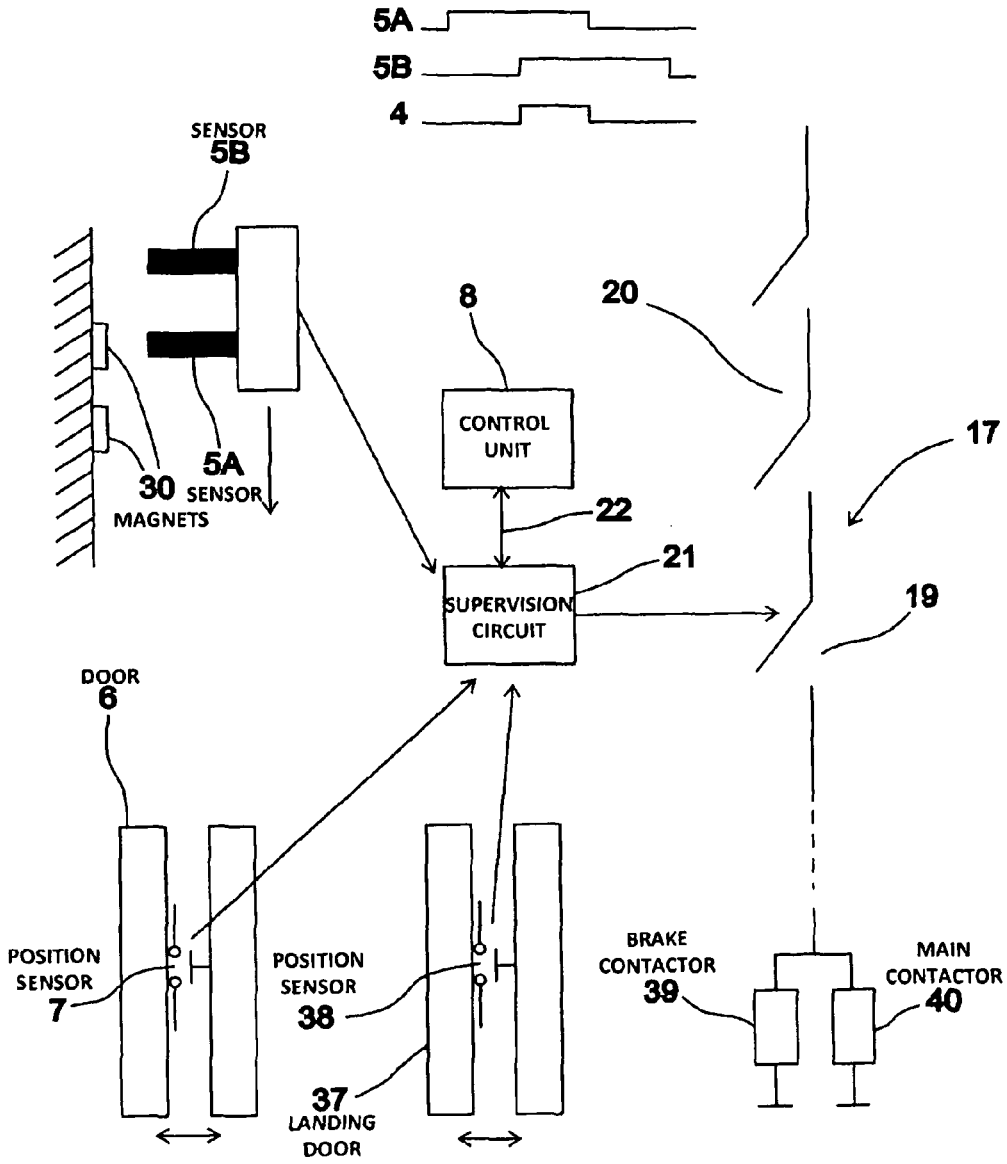
FIG. 3 illustrates one monitoring part of the movement of the elevator car according to the invention

The door zone 4 of the stopping floor 10 means the location of the elevator car 1 in the elevator hoistway 34, in which location the floor of the elevator car 1 is on essentially the same level with the floor of the stopping floor 10. The door zone can be set using e.g. the arrangement illustrated in FIG. 3. The reading device fixed in connection with the elevator car here comprises two sensors 5A, 5B that react to an external magnetic field, which sensors can be e.g. reed switches. Permanent magnets 30, on the other hand, are disposed in the elevator hoistway. The permanent magnets are disposed in relation to the sensors 5A, 5B of the reader device such that the elevator car is in the door zone when both the sensors 5A, 5B are disposed in the proximity of the permanent magnets 30 reacting to the magnetic field formed by the permanent magnets 30. Since the sensors are disposed in slightly different points in the direction of movement of the elevator car, the measuring signals of the sensors form the graphs presented in FIG. 3 when the reader device is moving downwards from above. The signal level "1" means that the sensor in question reacts to the magnetic field of the permanent magnets; the level "0", on the other hand, means that no external magnetic field is detected. The setting of the door zone can also be done in another way: for example, RFID identifiers can be disposed at different points in the elevator hoistway in the direction of movement of the elevator car, and the identifiers can be read with an RFID identifier reader fixed in connection with the elevator car. It is also possible to dispose a reader in the elevator hoistway and to fix permanent magnets/RFID identifiers in connection with the elevator car 1.

A control command for opening or for closing the brake is given to the brake control unit 29 with the drive unit 32 of the hoisting machine. The arrangement for preventing the drifting of an elevator car 1 away from the stopping floor comprises a monitoring part 16 of the operating condition of the machinery brake of the elevator, which part is fitted as a part of the software of the drive unit 32 of the hoisting machine.

In one embodiment of the invention a moment in the direction of the rotational movement of the hoisting machine is exerted on the hoisting machine 2 of the elevator, which moment essentially corresponds to the maximum permitted imbalance of the elevator. The elevator car 1 is in this case held in its position in the door zone 4 of the stopping floor when only the first of the machinery brakes 3 is activated and when the second of the machinery brakes is open. Movement of the hoisting machine 2 of the elevator car is determined with an encoder fitted co-axially with the axis of rotation to a rotating part of the hoisting machine, and possible slipping of the machinery brake is detected by examining the movement signal 12 received from the encoder. If it is detected that the machinery brake is slipping, it is deduced that the operating condition of the activated machinery brake in question has deteriorated and both machinery brakes 3 are immediately activated.

In a second embodiment of the invention the machinery brakes 3 of the hoisting machine are controlled and the operation of the machinery brakes 3 is measured with a microswitch 13 that is fitted between parts of the machinery brake that move with respect to each other, which microswitch changes its state when the machinery brake 3 activates/opens. If the state of the microswitch 13 does not change in a predetermined manner as a result of a control command of the machinery brake 3, it is deduced that the operability of the machinery brake 3 in question has deteriorated.

Regular monitoring of the operating condition of the machinery brakes 3 is necessary because the friction coefficient between the brake shoe and the brake drum or brake disc of the machinery brake can be reduced owing to, e.g. wear of the brake or some other reason. A contaminating substance such as oil or dirt can find its way onto the braking surface, or the brakes can be incorrectly adjusted.

When the operating condition of a machinery brake 3 is detected to have deteriorated, information about this is recorded in the non-volatile memory 9 of the elevator control unit 8, and the next run of the elevator is prevented.

The arrangement for preventing the drifting of an elevator car away from the stopping floor also comprises a monitoring part 17 of the movement of the elevator car. As presented in FIG. 3, the monitoring part 17 comprises a contactor 19 in the safety circuit 20 of the elevator. The monitoring part 17 also comprises a supervision circuit 21 of the door zone, fitted in connection with the control coil of the contactor 19. The supervision circuit 21 of the door zone is arranged to control the aforementioned contactor as a response to the position information of the elevator car expressed by the door zone sensors 5A, 5B of the elevator, to the information about the position and/or locking of the door of the elevator car expressed by the position sensor 7 of the door of the elevator car, as well as to the information about the position and/or locking of the landing door 37 expressed by the position sensor 38 of the landing door. Thus when it detects that the elevator car 1 has left the door zone 4 of the stopping floor when the door 6 of the elevator car and/or the landing door 37 is/are open, the supervision circuit 21 disconnects the current supply to the coil of the contactor 19, in which case the safety circuit 20 opens and the flow of current to the coil of the brake contactor 39 as well as to the coil of the main contactor 40 of the elevator ceases. At the same time the main contactor 40 opens, disconnecting the power supply to the hoisting machine 2, and the brake contactor 39 disconnects the flow of current to the electromagnets of the machinery brakes 3.

The status information of the contactor 19 of the monitoring part 17 is transferred to the elevator control unit 8 with a conductor 22 between the supervision circuit 21 and the elevator control unit 8. On the basis of the status information of the contactor 19, the elevator control unit 8 detects whether the elevator car 1 has left the door zone 4 when the door 6 of the elevator car and/or the landing door 37 is/are open. If the elevator control unit 8 has detected that the elevator car 1 has left the door zone 4 when the door 6 of the elevator car and/or the landing door 37 is/are open, the elevator control unit 8 switches the elevator into a control mode, in which the starting of the next run of the elevator is prevented. Information about the drive prevention of the elevator is also recorded in the non-volatile memory 9 of elevator control unit 8. Non-volatile memory means the type of memory, in which the recorded data is retained also over an electricity outage. These types of memories are e.g. flash EEPROM memory and also RAM memory, the electricity supply of which is backed up with a separate accumulator or battery.

Drive prevention data can also, if necessary, be sent e.g. to the service center via a wireless link.

The elevator control unit 8 comprises a display 25, with which a defect notification is displayed about the elevator car 1 leaving the door zone 4 when the door 6 of the elevator car and/or the landing door 37 is/are open.

Deactivation of the drive prevention of an elevator requires that a serviceman visits the elevator when deactivating the drive prevention using the keyboard 11 of the elevator control unit 8. At the same time the serviceman can perform an inspection procedure and/or servicing procedure of at least one machinery brake 3 after reading the defect notification.

Figure 2A:
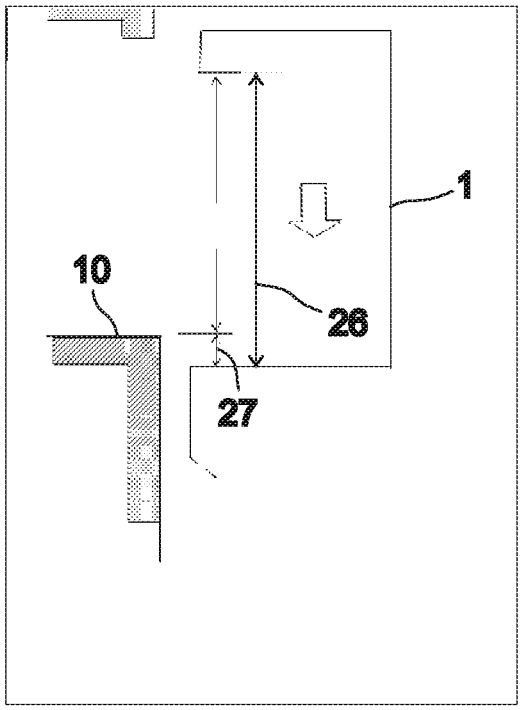
FIGS. 2A, 2B illustrate a dangerous situation to be prevented in the invention
Figure 2B:
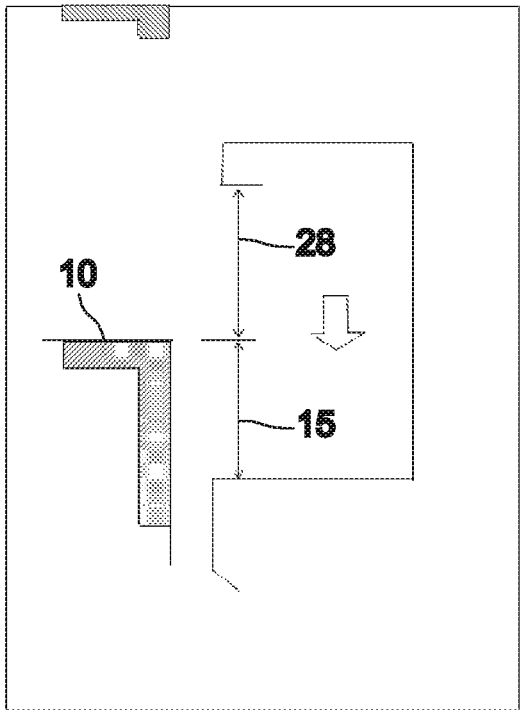
Figure 4:
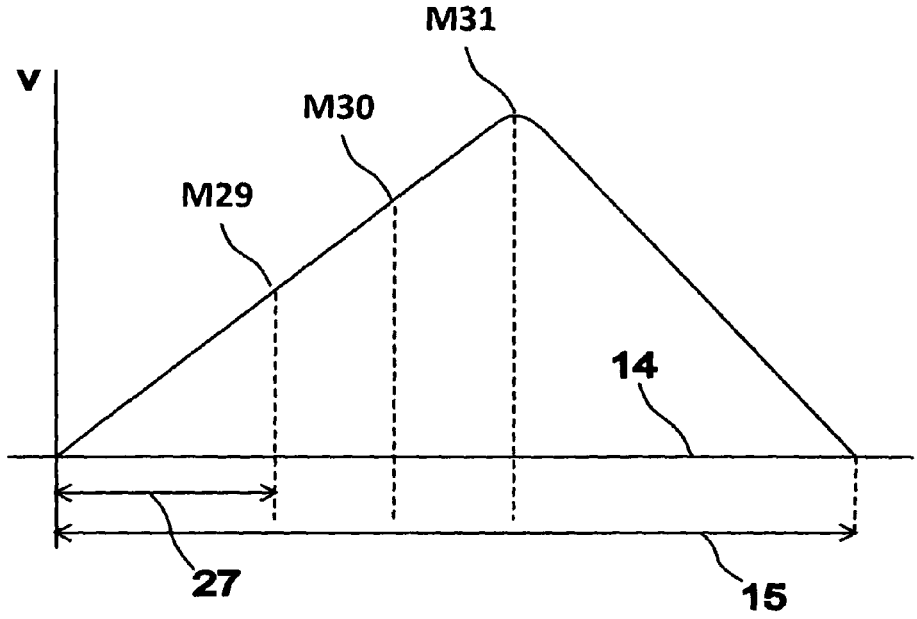
FIG. 4 illustrates the movement of the elevator car when the prevention of drifting away from the stopping floor is operating

FIGS. 2A and 2B illustrate the movement of the elevator car in a situation, in which the elevator car leaves the door zone 4 of the stopping floor 10 when the door 6 of the elevator car and/or the landing door 37 is/are open. FIG. 4 illustrates in more detail how the total length of the movement forms.

FIG. 2A presents a moment M29 according to FIG. 4 when an elevator car is detected to have moved the distance 27 to the limit of the door zone while the door of the elevator car and/or the landing door is/are open. After this, at moment M30 the machinery brakes are activated, and after an activation delay at the moment M31 the brakes engage to decelerate the speed of the elevator car. In the elevator system of FIG. 1 the machinery brakes 3 are dimensioned to stop an empty or essentially fully loaded elevator car 1 leaving from the door zone 4 of the stopping floor 10 within the stopping distance 15 marked in FIGS. 2B and 4, which stopping distance 15 is essentially shorter than the length 26 of the entrance of the elevator car in the direction of movement of the elevator car. The stopping distance is dimensioned such that after the elevator car 1 has stopped a sufficient safety margin 28 marked in FIG. 2B, remains between the stopping floor 10 and the door opening of the elevator car as human protection for a passenger that has remained between the stopping floor 10 and the door opening of the elevator car.

FIGS. 2A and 2B present a situation, in which the elevator car 1 leaves from the door zone 4 downwards. Ungoverned movement might, however, occur also upwards, in which case the safety margin 28 is dimensioned to the bottom part of the door opening of the elevator car 1, in a corresponding manner.

The invention is described above by the aid of a few examples of its embodiment. It is obvious to the person skilled in the art that the invention is not limited only to the embodiments described above, but that many other applications are possible within the scope of the inventive concept defined by the claims presented below.

The invention claimed is:

1. A method for suppressing drifting of an elevator car away from a stopping floor, the method comprising:

monitoring an operating condition of one or more machinery brakes of a hoisting machine of an elevator;

stopping, using the one or more machinery brakes, the elevator car from leaving a door zone of a stopping floor when at least one of a door of the elevator car and a landing door are open;

preventing start of a next run of an elevator car that has left the door zone of the stopping floor when the at least one of the door of the elevator car and the landing door are open; and recording information about the preventing of the next run in a non-volatile memory of an elevator control unit.

2. The method according to claim 1, wherein the stopping of the elevator car comprises:

exerting braking force on the hoisting machine with the one or more machinery brakes, the braking force being dimensioned to stop an essentially empty or fully loaded elevator car leaving the door zone of the stopping floor within a stopping distance, the stopping distance shorter than a length of an entrance of the elevator car in the direction of movement of the elevator car.

3. The method according to claim 1, wherein the location of the elevator car in the door zone is determined with door zone sensors, at least one of a position and locking of the door of the elevator car is determined with a position sensor of the door of the elevator car, and at least one of a position and locking of the landing door is determined with a position sensor of the landing door.

4. The method according to claim 1, further comprising:

activating the one or more machinery brakes of the hoisting machine; and disconnecting a power supply to the hoisting machine in response to detection that the elevator car has left the door zone of the stopping floor while at least one of the door of the elevator car and the landing door is open.

5. The method according to claim 1, further comprising:

displaying information about the elevator car leaving the door zone of the stopping floor when at least one of the door of the elevator car and the landing door is open.

6. The method according to claim 1, wherein at least one of at least one inspection procedure and at least one servicing procedure of the one or more machinery brakes is performed in response to a detection that the elevator car has left the door zone of the stopping floor when at least one of the door of the elevator car and the landing door is open.

7. The method according to claim 1, wherein the monitoring the operating condition comprises:

exerting a braking effect on the hoisting machine of the elevator in the which the direction of movement the braking effect essentially corresponding to a maximum permitted imbalance of the elevator;

controlling the one or more machinery brakes of the hoisting machine such that only one machinery brake is activated at a time, while others of the one or more machinery brakes remain;

examining a movement signal of the hoisting machine of the elevator; and if the movement signal of the hoisting machine indicates that the hoisting machine is moving when only one machinery brake is activated, deducing that the operating condition of the activated machinery brake has deteriorated.

8. The method according to claim 1, wherein the monitoring the operating condition comprises:

controlling the one or more machinery brakes of the hoisting machine; and measuring the operation of the one or more machinery brakes with a microswitch, the microswitch being configured to change its state when the one or more machinery brakes activates/opens;

wherein, if the state of the microswitch does not change as a result of a control command of the one or more machinery brakes, the operating condition of the one or more machinery brakes in question has deteriorated.

9. The method according to claim 8, wherein information about drive prevention of the elevator is recorded in the non-volatile memory of elevator control unit.

10. The method according to claim 1, wherein the preventing of the next run is deactivated using a manual deactivation device.

11. The method according to claim 1, wherein an elevator car at the door zone of the stopping floor is brought to a movement mode by reducing the braking force of one or more machinery brakes of the hoisting machine of the elevator when at least one of the door of the elevator car and the landing door is open.

12. The method according to claim 1, further comprising:

bringing an elevator car in the door zone of the stopping floor to a movement mode when at least one of the door of the elevator car and the landing door is open by opening one or more of the machinery brakes that brake the hoisting machine;

activating one or more machinery brakes of the hoisting machine in response to detection that an elevator car has left the door zone of the stopping floor when at least one of the door of the elevator car and the landing door is open;

measuring, after the movement of the elevator car has stopped, the distance that the elevator car has moved from the door zone of the stopping floor;

comparing the distance moved by the elevator car from the door zone with a determined reference value, the reference value being less than a length of the entrance of the elevator car in the direction of movement of the elevator car; and determining the operability of the one or more activated machinery brake based on the comparison.

13. The method according to claim 1, further comprising:

fitting a plurality of machinery brakes in connection with the hoisting machine;

holding the elevator car in the door zone of the stopping floor when only a first of the plurality of machinery brakes is activated and when a second of the plurality of machinery brakes is open; and stopping the elevator car from leaving the door zone of the stopping floor when at least one of the door of the elevator car and the landing door is open by activating the plurality of machinery brakes.

14. An arrangement for suppressing drifting of an elevator car away from a stopping floor, the arrangement comprising:

one or more machinery brakes to brake a movement of the hoisting machine of an elevator;

a first monitoring part to monitor an operating condition of the one or more machinery brakes;

a second monitoring part to monitor movement of the elevator car, the second monitoring part being further configured to stop the elevator car from leaving a door zone of the stopping floor when at least one of the door of the elevator car and the landing door is open using the one or more machinery brakes;

a non-volatile memory in the elevator control unit;

wherein the arrangement is configured to prevent starting of a next run of an elevator car that has left the door zone of the stopping floor when at least one of the door of the elevator car and the landing door is open; and wherein the non-volatile memory is configured to record information about the preventing of the starting of the next run of the elevator car.

15. The arrangement according to claim 14, further comprising:

a display in the elevator control unit, the display being configured to display information about the elevator car leaving the door zone of the stopping floor when at least one of the door of the elevator car and the landing door is open.

16. The arrangement according to claim 14, wherein the second monitoring part is further configured to disconnect a power supply to the hoisting machine of the elevator in response to detecting that the elevator car has left the door zone of the stopping floor when at least one of the door of the elevator car and the landing door is open.

17. The arrangement according to claim 14, wherein the first monitoring part is configured to determine the operating condition of the one or more machinery brakes based on at least one of a movement signal of the hoisting machine and the measured data of the microswitch of the one or more machinery brakes, and wherein the second monitoring part is configured to determine the leaving of an elevator car from the door zone of the stopping floor when at least one of the door of the elevator car and the landing door is open, using at least one of a position sensor of the door of the elevator car, a position sensor of the landing door and door zone sensors.

18. The arrangement according to claim 14, wherein the first monitoring part is configured to set a drive prevention mode of the elevator based on the operating condition of the one or more machinery brakes.

19. The arrangement according to claim 14, wherein the second monitoring part comprises:

a controllable switch in a safety circuit of the elevator;

a supervision circuit fitted in connection with a control pole of the controllable switch, the supervision circuit being configured to control the controllable switch in response to at least one of, position information of the elevator car from the door zone sensors of the elevator, information about at least one of a position and locking of the door of the elevator car from a position sensor of the door of the elevator car, and information about at least one of a position and locking of the landing door from a position sensor of the landing door.

20. The arrangement according to claim 19, wherein a data transfer channel is between an elevator control unit and the supervision circuit of the door zone, the data transfer channel being configured to notify of the elevator control unit of the leaving of the elevator car from the door zone of the stopping floor when at least one of the door of the elevator car and the landing door is open.

21. The arrangement according to claim 14, wherein the one or more machinery brakes are configured to stop an empty or essentially fully loaded elevator car leaving the door zone of the stopping floor within a stopping distance, the stopping distance being less than a length of the entrance of the elevator car in the direction of movement of the elevator car.

22. The arrangement according to claim 14, further comprising:

a manual deactivation device to deactivate a drive prevention mode of the elevator as a result of a manual control function.

23. The arrangement according to claim 14, further comprising:

a plurality of machinery brakes;

wherein the first monitoring part is configured to hold the elevator car in its position in the door zone of the stopping floor by activating a first of the plurality of machinery brakes and by opening a second of the plurality of machinery brakes; and wherein the second monitoring part is configured to stop the elevator car leaving the door zone of the stopping floor when at least one of the door of the elevator car and the landing door is open by activating the plurality of machinery brakes.

* * * * *